US008651347B1

(12) United States Patent
Molcho et al.

(10) Patent No.: US 8,651,347 B1
(45) Date of Patent: Feb. 18, 2014

(54) APPARATUS AND METHOD FOR CARRYING AND RETRIEVAL OF A GRENADE

(71) Applicant: Nirtal Training and Supply of Combat Equipment Ltd., Or-Yehuda (IL)

(72) Inventors: Haim Molcho, Zur Hadassah (IL); Nir Shaul, Ramat Hasharon (IL)

(73) Assignee: Nirtal Training and Supply of Combat Equipment Ltd., Or-Yehuda (IL)

( * ) Notice: Subject to any disclaimer, the term of this patent is extended or adjusted under 35 U.S.C. 154(b) by 0 days.

(21) Appl. No.: 13/915,635

(22) Filed: Jun. 12, 2013

Related U.S. Application Data

(63) Continuation-in-part of application No. 13/648,286, filed on Oct. 10, 2012.

(51) Int. Cl.
*F42B 39/00* (2006.01)
*B65D 43/16* (2006.01)

(52) U.S. Cl.
USPC ..... 224/241; 224/242; 224/191; 224/660

(58) Field of Classification Search
USPC ..... 224/242, 245, 163, 191, 660, 235, 241, 224/914, 236; 102/368, 482–488; D29/128
See application file for complete search history.

(56) References Cited

U.S. PATENT DOCUMENTS

| | | | | | |
|---|---|---|---|---|---|
| 2,067,829 | A * | 1/1937 | Denne | 169/30 |
| 2,532,244 | A * | 11/1950 | Pasmore | 220/278 |
| 2,670,886 | A * | 3/1954 | Walton | 224/247 |
| 2,797,034 | A * | 6/1957 | Blackman | 224/603 |
| 4,513,877 | A * | 4/1985 | Taguchi et al. | 220/830 |
| 5,358,110 | A * | 10/1994 | Simpson | 206/316.2 |
| 5,644,792 | A * | 7/1997 | Tishler et al. | 2/2.5 |
| 5,724,707 | A * | 3/1998 | Kirk et al. | 24/3.7 |
| 5,944,238 | A * | 8/1999 | Stark | 224/148.4 |
| 7,669,742 | B2 * | 3/2010 | Rush | 224/148.7 |
| 2011/0101063 | A1 * | 5/2011 | Zusman | 224/682 |
| 2012/0111882 | A1 * | 5/2012 | Milligan et al. | 221/1 |
| 2012/0175391 | A1 * | 7/2012 | Rogers et al. | 224/182 |

* cited by examiner

*Primary Examiner* — Nathan J Newhouse
*Assistant Examiner* — Scott McNurlen
(74) *Attorney, Agent, or Firm* — Soroker-Agmon

(57) ABSTRACT

The subject matter discloses an apparatus, having an envelope and a base for holding a grenade, a rear cover connected to the envelope for attaching said envelope to a vest; a top cover to secure the grenade from above when positioned in a downward position and moving upwards to an upward position; a spring connected to the top cover and to the envelope and a button that causes the top cover to move to the upward position when pressed by the user. The button is located below the top cover and connected only to one of the envelope or the rear cover. The user of the apparatus can release the grenade from the apparatus while pressing the button and the envelope is designed to enable the user to hold the grenade and the grenade lever singlehandedly when pressing the button and when releasing the grenade from the apparatus.

19 Claims, 9 Drawing Sheets

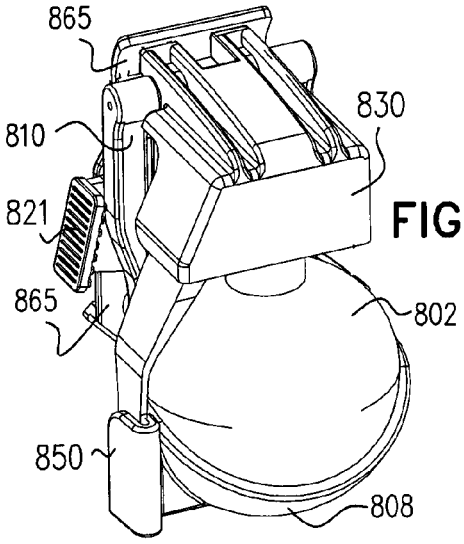
FIG. 8A
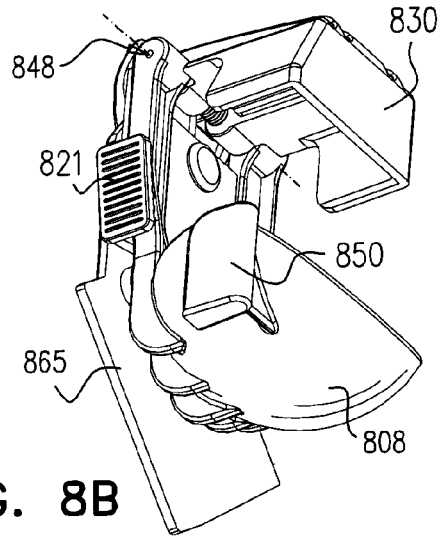
FIG. 8B
FIG. 9A
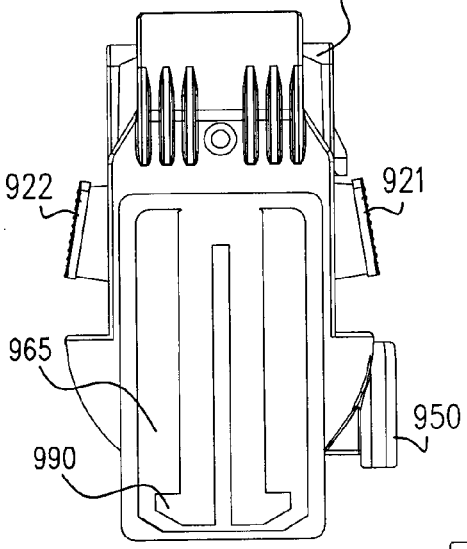
FIG. 9B
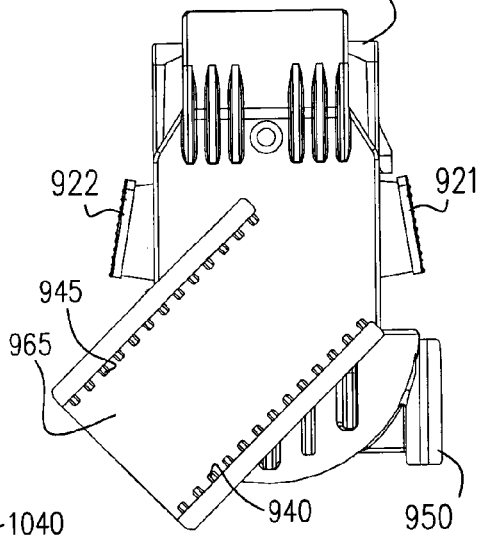
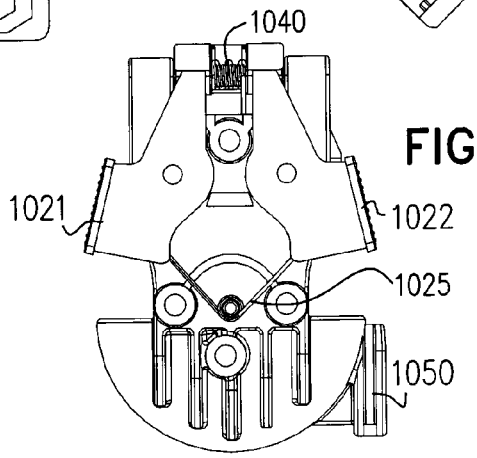
FIG. 10

APPARATUS AND METHOD FOR CARRYING AND RETRIEVAL OF A GRENADE

This application is a CIP application of U.S. patent application Ser. No. 13/648,286 filed on Oct. 10, 2012.

FIELD OF THE INVENTION

The subject matter relates generally to a retrieval envelope for carrying grenades and rapidly deploying the grenades.

BACKGROUND OF THE INVENTION

Grenades are explosive devices used by various personnel, such as law enforcement personnel or military officers, as a projectile to attack a target at a distance from a thrower. There are various types of grenades available, such as a fragment grenade, stun grenade, smoke grenade, incendiary grenade, etc. When used, grenades create an explosion which is intended to injure, emit a blaring noise, create smoke, and the like. Grenades may be thrown through a window or door of a crime location, such as a room in a house, and the like, to temporarily distract the occupants for a time sufficient to enable the law enforcement personnel to safely enter the location and neutralize any potential threats.

The grenade is held in a throwing hand with the thumb placed over a grenade lever while a safety pin is pulled out of a safety pin hole. When the grenade is thrown, the grenade lever is released, a spring throws off the grenade lever and rotates the striker into the primer. The primer contains material similar to the head of a match. When struck, it ignites and sets fire to the fuse. The fuse burns at a controlled rate, providing a time delay, for example about four to five seconds. When the flame of the fuse reaches a detonator the grenade explodes.

In order to separate the safety pin from the grenade, the user that throws the grenade is required to hold the grenade in one hand then pull the safety pin in the other hand, thus requiring the use of both hands in the handling of the grenade. A user that operates the grenade in both hands cannot operate the single weapon at the same time. During operation, removal of the grenade from a pouch and separating the safety pin from the grenade may be inconvenient, time consuming and intricate, factors which are critical to the success of situations requiring the use of grenades.

SUMMARY

The subject matter provides for an apparatus for quick release of a grenade in a single hand. The apparatus, comprising an envelope and a base connected to a bottom portion of the envelope for holding a grenade, a rear cover connected to the envelope for attaching said envelope to a vest of a user; a top cover connected to an upper portion of the envelope or the rear cover, said top cover secures the grenade from above when positioned in a downward position and moves upwards to an upward position; a spring connected on one end to the top cover and on another end to the envelope; at least one button connected to the envelope or to the rear cover, wherein pressing the at least one button releases the spring and causes the top cover to move to the upward position.

The user of the apparatus can release the grenade from the apparatus while pressing the at least one button. The at least one button is located below the top cover and connected only to one of the envelope or the rear cover. The envelope is designed to enable the user to hold the grenade and the grenade lever in a single hand when pressing the at least one button and when releasing the grenade from the apparatus.

The top cover is made of a rigid material. The top cover may surround an upper portion of the grenade, thereby securing explosives included in said upper portion. The top cover is connected to the envelope on an axis, wherein the top cover moves to the upward position in a rotational movement around the axis.

The apparatus further comprising a protruding tooth for pushing the grenade away from the envelope when the top cover moves to the upward position, said protruding tooth protrudes from the top cover. The apparatus further comprising a soft inner lining connected to a bottom portion of the top cover being in contact with an upper portion of the grenade when the top cover is in the downward position. The spring is tensed when the top cover is in the downward position, wherein the spring is released when the at least one button is pressed, thereby the top cover moves to the upward position.

The top cover may have protruding elements that are mounted on an upper end of the at least one button when the top cover is in the downward position and the spring is tensed, and wherein pressing the at least one button changes the location of the upper end of the at least one button, thereby enabling the protruding elements to move downwards and release the spring, such that the top cover is enabled to move to the upward position.

The at least one button may be two buttons, wherein the protruding elements are positioned between the two buttons when the top cover is moved to the upward position, to prevent the two buttons to return to their original position. Pressing only one button of the two buttons fails to release the spring and fails to move the top cover to the upward position. The apparatus may also include a back spring connecting the two buttons, such that when the top cover is pushed downwards by the user, the back spring is tensed and the two buttons are distanced from each other. The two buttons may automatically be triggered by the back spring when the top cover is in the downward position.

The apparatus may further comprise a mechanical track connected to the rear cover for connecting the apparatus to the garment, wherein the mechanical track enables connecting the apparatus to a plurality of locations on the garment. The apparatus may further comprise a drop shot hook used for hanging the apparatus on the vest without an adapter. The apparatus may further comprise a safety lever container connected to the envelope, said safety lever container is configured to secure and protect the grenade lever of the grenade.

The apparatus may further comprise a ring holder connected to the envelope, said ring holder is configured to hold the pull ring, such that the pull ring is detached from the grenade responsive to removal of the grenade from the envelope. The ring holder may be a karabiner, wherein the karabiner is fastened to the pull ring. The ring holder may be connected to the envelope by a cord, such that the pull ring is detached from the grenade responsive to moving the grenade from the envelope at a distance longer than the cord's length. The rear cover may be connected to the vest at an angle versus the ground.

BRIEF DESCRIPTION OF THE DRAWINGS

Exemplary non-limited embodiments of the disclosed subject matter will be described, with reference to the following description of the embodiments, in conjunction with the figures. The figures are generally not shown to scale and any sizes are only meant to be exemplary and not necessarily limiting. Corresponding or like elements are optionally designated by the same numerals or letters.

FIG. 8A shows a front view of an apparatus for holding a sphere-like shaped grenade with a top cover in an upward position, according to some exemplary embodiments of the subject matter;

FIG. 8B shows a front view of an apparatus for holding a sphere-like shaped grenade with a top cover in a downward position, according to some exemplary embodiments of the subject matter;

FIG. 9A shows a rear view of an apparatus for holding a sphere-like shaped grenade with a top cover in an upward position, according to some exemplary embodiments of the subject matter;

FIG. 9B shows a rear view of an apparatus for holding a sphere-like shaped grenade with a top cover in a downward position, according to some exemplary embodiments of the subject matter;

FIG. 10 shows a rear view of an apparatus for holding a grenade, according to some exemplary embodiments of the subject matter;

DETAILED DESCRIPTION

The present subject matter discloses a retrieval envelope for holding a grenade and a method of using the same, according to exemplary embodiments. A person, such as a law enforcement or military officer, inserts the grenade into the retrieval envelope, which partially envelopes the grenade while enabling rapid retrieval of the grenade. The grenade is secured in the retrieval envelope by a top cover, which is pushed down and locked into place over the top of the grenade. When the person wishes to use the grenade, he raises the top cover to enable removing the grenade. The top cover may be detached from the apparatus of the subject matter. Raising the top cover may be performed by activating a trigger, which releases a spring, which may also be a rubber band or a latch, raises the top cover. In some cases, the trigger comprises pressing at least two triggers simultaneously to prevent unwanted release of the top cover. The grenade may further be secured by one or more teeth or flaps which hold the grenade in the retrieval envelope, but are flexible enough to enable rapid and easy removal of the grenade from the retrieval envelope. The retrieval envelope enables the person to rapidly retrieve the grenade from the retrieval envelope and throw it rapidly and accurately at a desired target. The retrieval of the grenade may be done with a single hand and may be done by a person's weak hand, while a strong hand carries a primary weapon, such as an automatic rifle.

The retrieval envelope comprises of a safety lever container for containing the grenade lever and for maintaining the orientation of the grenade in the retrieval envelope. The retrieval envelope comprises a ring holder attached to a safety pin of the grenade. The ring holder enables the person to release and use the grenade rapidly and using a single hand. The ring holder holds onto the safety pin as the person moves the grenade away from the retrieval envelope, which releases the safety pin and permits throwing the grenade at a desired target. The retrieval envelope is attached to a garment, which may be a vest, a belt or any other apparel used by the person. The retrieval envelope may be attached to the garment by use of an attachment utensil, such as screws, sewing, buttons, or the like.

Figure 1:
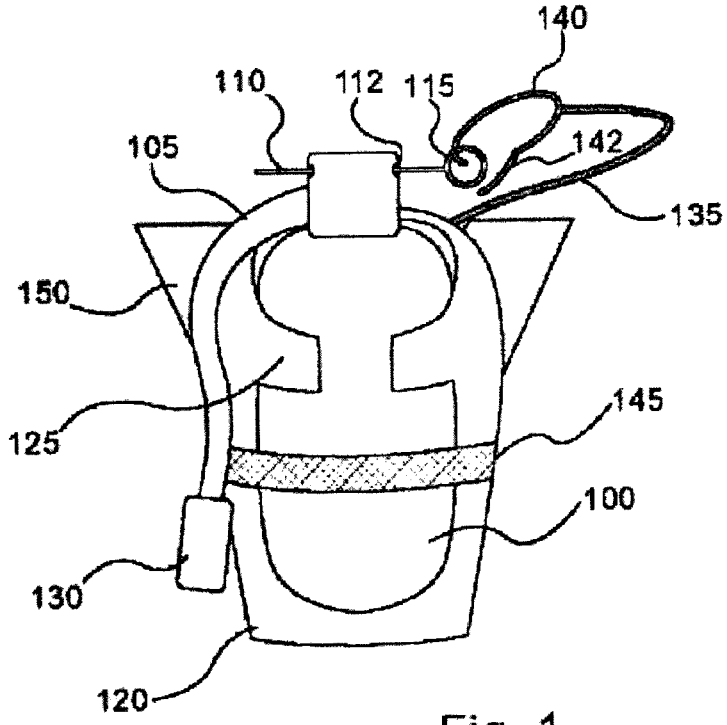
FIG. 1 shows a retrieval envelope holding a grenade, according to some exemplary embodiments of the subject matter.

FIG. 1 shows a retrieval envelope holding a grenade, according to some exemplary embodiments of the subject matter. The grenade 100 comprises a safety pin 110 and a grenade lever 105. The safety pin 110 is placed into a pin hole 112 that keeps the grenade lever 105 in place, preventing a release spring (not shown) from releasing the grenade lever 105 and detonating the grenade 100. The grenade 100 is placed into retrieval envelope 120.

The retrieval envelope 120 is designed to hold the grenade 100 so the shape of the retrieval envelope 120 is configured for quick access and use. In some exemplary embodiments, the retrieval envelope 120 may comprise flaps 125, which secure the grenade 100 in the retrieval envelope 120. The retrieval envelope 120 may comprise a safety lever container 130, which holds the grenade lever 105. Holding the grenade lever 105 at the safety lever container 130 prevents the grenade 100 from disorienting when placed in the retrieval envelope 120. In some cases, the safety lever container 130 may prevent the grenade lever 105 from releasing in situations where the safety pin 110 is prematurely removed or slips out of the safety pin hole 112.

The retrieval envelope 120 may also comprise a hook 150 to attach the retrieval envelope 120 to a garment such as a vest or a belt. The hook 150 allows convenient transportation of one or multiple retrieval envelopes 120 to and from the garment.

The retrieval envelope 120 comprises a cord 135, such as a rope or wire, which is connected to a ring holder 140. The ring holder may be a karabiner comprising a mobile limb 142. The ring holder 140 is attached to a safety pin ring 115. Once the ring holder 140 is inserted into the safety pin ring 115, the safety pin ring 115 may be removed once the person using the retrieval envelope 120 pulls the grenade 100 out and away from the retrieval envelope 120, so the safety pin 110 is released from the safety pin hole 112 by the ring holder 140.

In some exemplary embodiments of the subject matter, a rubber band 145 may be used to secure the grenade 100 in the retrieval envelope 120. The rubber band 145 is placed around the grenade 100 and the retrieval envelope 120 so the grenade 100 may be easily removed from the retrieval envelope 120 using a single hand. In some embodiments, the rubber band 145 may be attached to the retrieval envelope 120 so the rubber band 145 does not fall to the ground and get lost when the grenade 100 is removed from the retrieval envelope 120. The rubber band 145 is detached from the grenade 100 when deploying the grenade 100.

Figure 2:
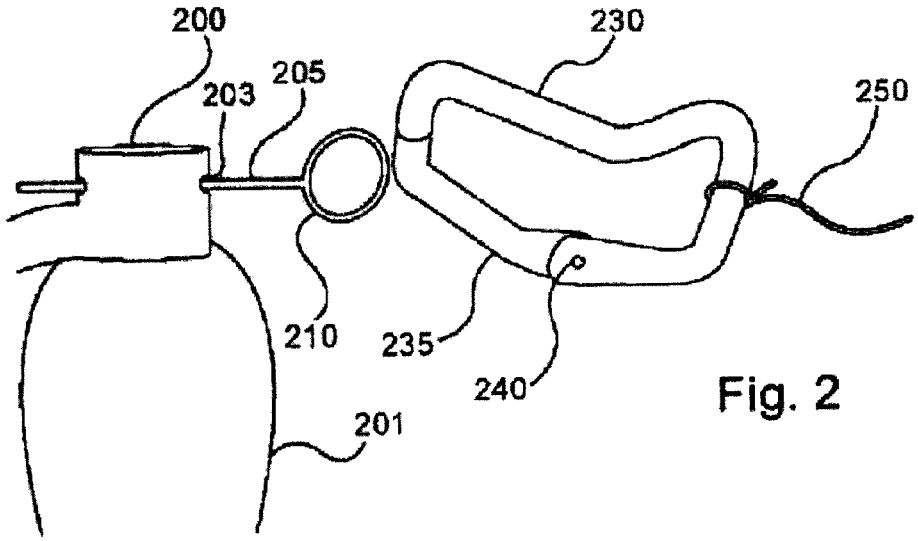
FIG. 2 shows a ring holder connection to a safety pin, according to some exemplary embodiments of the subject matter.

FIG. 2 shows a ring holder connection to a safety pin, according to exemplary embodiments of the subject matter. The safety pin 205 is inserted into a safety pin hole 203 located on a grenade lever 200 of a grenade 201. The grenade pin 205 comprises a safety pin ring 210. After the safety pin ring 210 is pulled, the safety pin 205 is removed out of the safety pin hole 203, which enables the grenade lever 200 to be released, igniting the fuse to detonate the grenade 201. A ring holder 230, such as a karabiner, is inserted into the safety pin ring 210. The ring holder 230 comprises a ring holder mechanism, such as a moveable limb 235, which can open and close to enable insertion of the ring holder 230 into the safety pin ring 210. The moveable limb 235 is attached to the body of the ring holder 230 by a bolt 240, such as a screw, which enables the moveable limb 235 to open and close. The ring holder 230 is attached to a cord 250, such as a rope or wire, which connects the ring holder 230 to the retrieval envelope 120 of FIG. 1.

Once the ring holder 230 is inserted into the safety pin ring 210, the moveable limb 235 is placed so the ring holder 230 cannot be removed from the safety pin ring 210 without opening the moveable limb 235. In some cases the ring holder 230 may have a locking bolt (not shown), such as a locking karabiner, which has the locking bolt to enable locking the moveable limb 235 into place to prevent the moveable limb 235 from opening and releasing the safety pin 205, for example, while the grenade 201 is being removed from the retrieval envelope 120 of FIG. 1.

Figure 3:
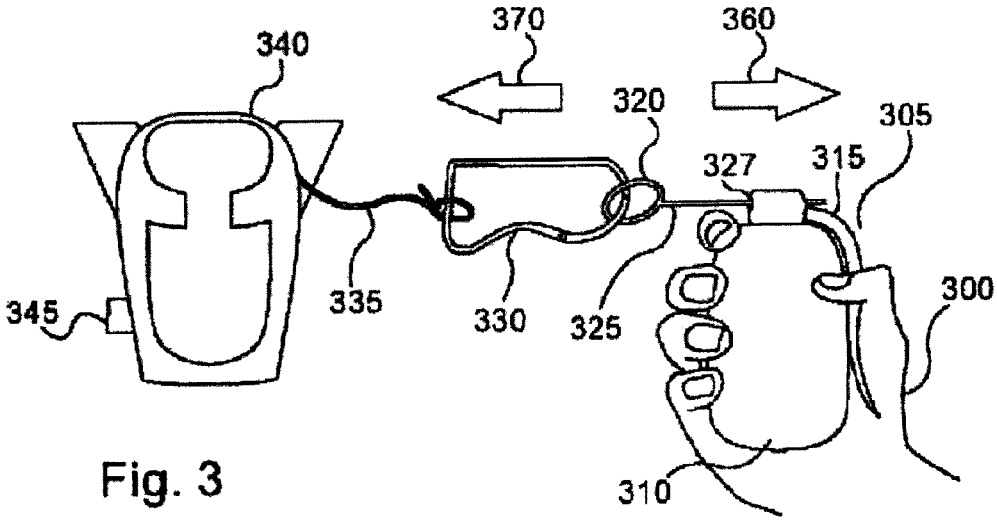
FIG. 3 shows a release of a grenade from a retrieval envelope, according to some exemplary embodiments of the subject matter.

FIG. 3 shows a method of releasing a grenade from a retrieval envelope, according to exemplary embodiments of the subject matter. A person carrying the retrieval envelope 340 uses a hand 300 to grab onto a grenade 310 located in the retrieval envelope 340. The hand 300 grabs the grenade 310 so that some fingers keep a grenade lever 315 from releasing, for example using a thumb 305 to hold the grenade lever 315 in place. The thumb 305 is used to remove the grenade 310 from the retrieval envelope 340 in a single fast motion. The grenade lever 315 is removed from a safety lever container 345 and controlled with the thumb 305 so the grenade lever 315 does not release, preventing the grenade 310 from detonating once a safety pin 325 is released. The safety pin 325 is located in a safety pin hole 327, which keeps the grenade lever 315 locked and prevents the grenade 310 from detonating until the safety pin 325 is removed from the safety pin hole 327. The safety pin 325 comprises a safety pin ring 320, attached to a ring holder 330. The ring holder 330 is inserted into the safety pin ring 320 so the ring holder 330 and the safety pin ring 320 are interlocked and cannot be detached. The ring holder 330 is attached to a cord 335, such as a rope or wire, which is connected to the retrieval envelope 340 at the opposite end of the cord 335.

To activate the grenade 310, the person carrying the retrieval envelope 340 that holds the grenade 310, grabs the grenade 310 with the person's hand 300. The person places one of his/her fingers around the grenade lever 315 to ensure that the grenade 310 does not detonate in the person's hand 300. After removing the grenade 310 from the retrieval envelope 340, the person moves the grenade 310 away from the retrieval envelope 340, for example moving the grenade 310 in a right direction 360 or moving the retrieval envelope 340 in a left direction 370. The retrieval envelope 340 enables the person to use only a single hand to remove the grenade 310 from the retrieval envelope 340 and still have a second hand free for other requirements, such as carrying an automatic rifle. The retrieval envelope 340 enables the person to rapidly remove the grenade 310 from the retrieval envelope 340 and throw it rapidly with either a person's strong or weak hand.

As the grenade 310 is moved further from the retrieval envelope 340, the cord 335 becomes tense and the ring holder 330 at the end of the cord 335 pulls the safety pin 325 out of the safety pin hole 327. The retrieval envelope 340, which sits on a garment of the person, such as a person's vest, creates tension in the cord 335, which enables the ring holder 330 to remove the safety pin 325 from the safety pin hole 327 as the grenade 310 is distanced from the retrieval envelope 340. The distance between the grenade 310 and the retrieval envelope 340 may be longer than the length of the cord 335 in order to release the safety pin 325. Once the safety pin 325 is removed from the safety pin hole 327, the grenade lever 315 is secured by the person's hand 300, for example the thumb 305. To activate the grenade 310, the person releases the grenade 310 enabling the grenade lever 315 to be released by a spring (not shown). Once the grenade lever 315 releases the fuse inside the grenade 310 ignites the primer, which detonates the grenade 310.

Figure 4:
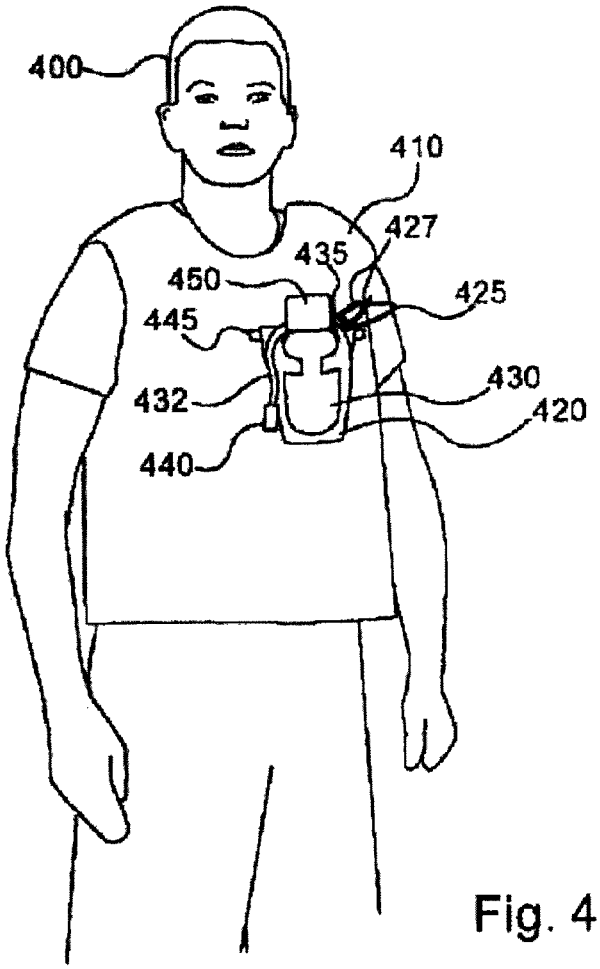
FIG. 4 shows a retrieval envelope attached to a garment on a person, according to some exemplary embodiments of the subject matter; and, FIG. 5 shows a side view of a retrieval envelope holding a grenade, according to some exemplary embodiments of the subject matter.

FIG. 4 shows a retrieval envelope attached to a garment on a person, according to exemplary embodiments of the subject matter. The person 400, such as a law enforcement officer, wears a garment 410, such as a vest or a belt (not shown), on which the retrieval envelope 420 may be attached. The retrieval envelope 420 may be attached to the garment 410 by hooks 445, screws, stitches, and the like. The retrieval envelope 420 may be attached to a mechanical track using hooks 445, which enables adjusting the location of the retrieval envelope 420 on the garment 410. The retrieval envelope 420 is attached to the garment 410 so a grenade 430 is easily accessible to the person 400. A top cover 450, which may be attached to the body of the retrieval envelope 420, is placed on top of the grenade 430, to prevent the grenade 430 from falling out of the retrieval envelope 420. A grenade lever 432 is placed in a safety lever container 440 on the retrieval envelope 420. The safety lever container 440 orients the grenade 430 so the person 400 only requires one hand to remove the grenade 430 from the retrieval envelope 420. The safety lever container 440 securely holds the grenade lever 432 so the grenade lever 432 is not detached from the grenade 430. The person 400 releases the top cover 450 from the grenade 430 using a trigger, for example by pressing two buttons that release a spring, which lifts the top cover 450 from the grenade 430. In some cases the spring may be a rubber band, a latch, or the like. The person 400 grabs the grenade 430 with the person's hand and removes the grenade lever 432 from the safety lever container 440 while removing the grenade 430 from the retrieval envelope 420. The grenade 430 is moved away from the retrieval envelope 420, for example by pulling the grenade 430, a cord 425 becomes tense and a ring holder 427, for example a karabiner, pulls on a safety pin 435 on the grenade 430. The person 400 moves the grenade 430 until the safety pin 435 is removed from the grenade 430 and remains attached to the ring holder 427. Once the safety pin 435 is removed the grenade 430 may be thrown at a desired target. When inserting the grenade 430 into the retrieval envelope 420, the user may first attach the ring holder 427 to the safety pin 435, then insert the grenade 430 into the retrieval envelope 420 and finally cover the grenade 430 using the top cover 450.

Figure 5:
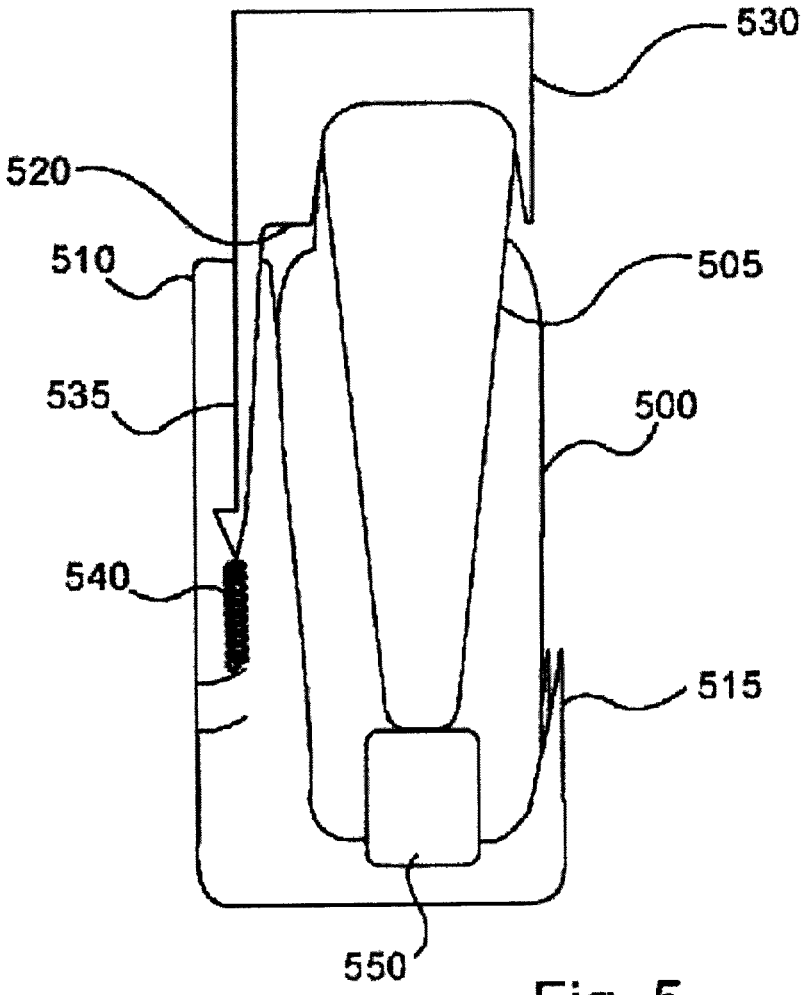

FIG. 5 shows a profile of retrieval envelope holding a grenade, according to some exemplary embodiments of the subject matter. The grenade 500 is held in the retrieval envelope 510. The grenade 500 is placed in a large cavity of the retrieval envelope 510. In some exemplary embodiments of the subject matter, the retrieval envelope 510 comprises one or more teeth 515, which are located in the opening of the large cavity and keep the grenade 500 from falling out of the retrieval envelope 510. The one or more teeth 515 are flexible, so the one or more teeth 515 bend as the grenade 500 is removed from the retrieval envelope. In some cases, the retrieval envelope 510 comprises a holding ledge 520, which prevents the grenade 500 from moving while the grenade 500 is stored in the retrieval envelope 510. The grenade 500 comprises a grenade lever 505, which is stored in a safety lever container 550. The retrieval envelope comprises a top cover 530, which is placed on top of the grenade 500 to prevent the grenade 500 from moving while being stored in the retrieval envelope 510. In some cases, the top cover 530 comprises a soft inner lining (not shown), such as a sponge or rubber, to further prevent the grenade 500 from moving while being stored in the retrieval envelope 510. The top cover 530 pushes the grenade 500 down into the retrieval envelope to prevent the grenade 500 from falling. The top cover 530 may be detached from the grenade 500. The top cover 530 comprises an elongated limb 535, which enters into a wall of the retrieval envelope 510, for example a back wall. The elongated limb 535 rests on a spring 540, which is used to raise the top cover 530 when the grenade 500 is removed from the retrieval envelope 510. In some exemplary embodiments of the subject matter, the spring 540 may be a rubber band, a latch or the like.

After the grenade 500 is placed in the retrieval envelope 510 the top cover 530 is pressed down onto the top of the grenade 500 to hold the grenade 500 in place. As the top cover 530 is brought down the extended limb 535 is locked into place inside of the retrieval envelope 510, for example, being caught on a ledge (not shown). To remove the grenade 500 from the retrieval envelope 510, a trigger of some sort, for example pressing two buttons simultaneously, is used to release the extended limb 535 and the spring 540 pushes the top cover 530 up, which enables removing the grenade 500 from the retrieval envelope 510. In some exemplary embodiments of the subject matter, the top cover 530 moves backwards in a swinging motion from the top of the grenade 500. The grenade lever 505 is removed from the safety lever container 550 and the grenade 500 is pulled out of the retrieval envelope 510 while bending the one or more teeth 515.

Figure 6A:
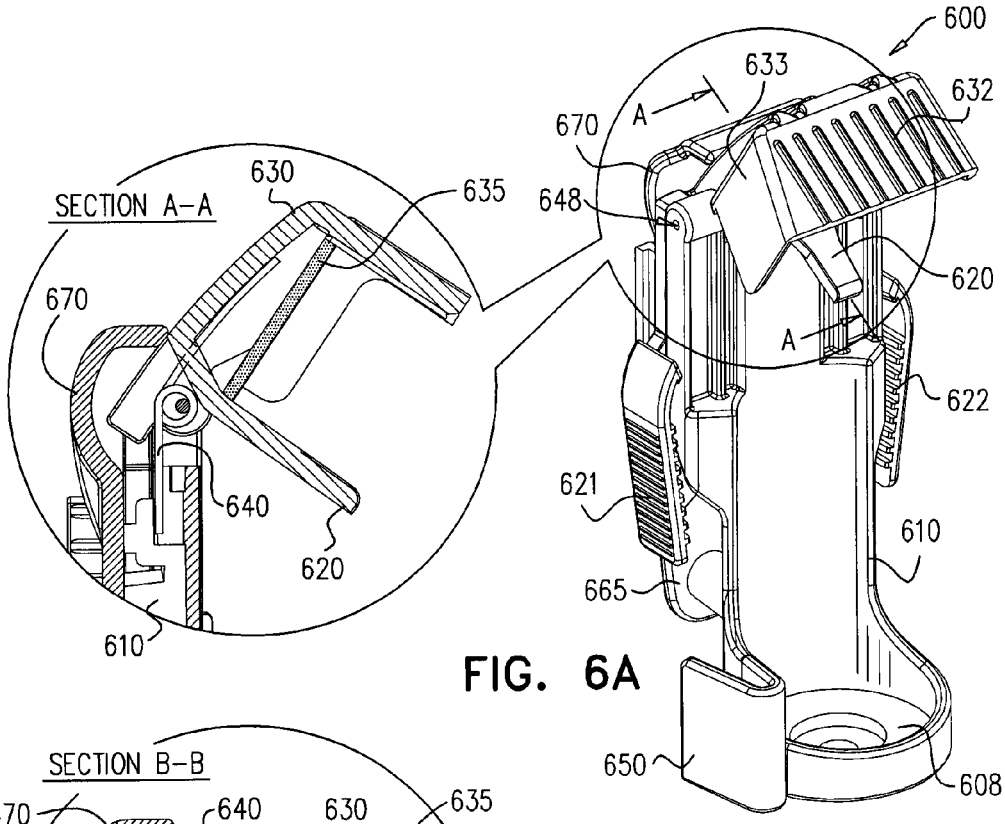
FIG. 6A shows a front view of an apparatus for holding a grenade with a top cover in an upward position, according to some exemplary embodiments of the subject matter.
Figure 6B:
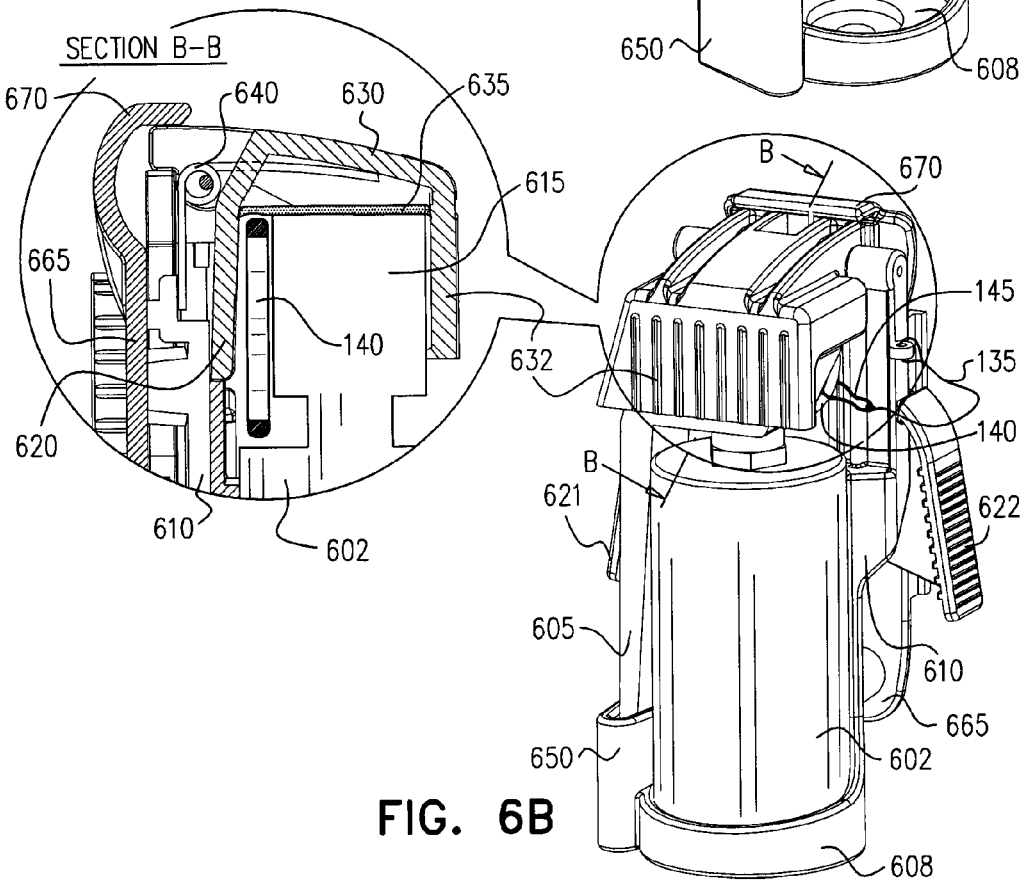
FIG. 6B shows a front view of an apparatus for holding a grenade with a top cover in a downward position, according to some exemplary embodiments of the subject matter.

FIG. 6A shows a front view of an apparatus for holding a grenade with a top cover in an upward position, according to some exemplary embodiments of the subject matter. The apparatus 600 comprises a safety lever container 650 for securing and protecting a grenade lever 605 in place. The apparatus 600 comprises a base 608 and an envelope 610 connected to the base 608. The envelope 610 includes at least one wall for securing the grenade. The grenade is mounted on top of the base 608. A top cover 630 is connected to the upper portion of the envelope 610. When the top cover 630 is in a downward position, as shown in FIG. 6B, the top cover 630 is in contact with the upper portion of the grenade and secures the grenade towards the base 608, to prevent movement of said grenade inside the apparatus 600. In some cases, the top cover 630 protects and surrounds the upper portion 615 of the grenade. In some cases, the top cover 630 is connected to an axis 648. The axis 648 is connected to the envelope 610 and enables the top cover 630 to move in a rotational movement around the axis 648 between the upward position and the downward position.

In some exemplary cases, the apparatus 600 also comprises a spring 640 connected on one end to the top cover 630. The spring 640 is also connected on its other end to another part in the apparatus 600, for example to the axis 648 or to the envelope 610. When the spring 640 is tensed, the top cover 630 is in the downward position. When two buttons 621, 622 are pressed, the spring 640 is released and the top cover 630 moves to the upward position. The top cover 630 may move in a rotational movement, as the axis of the rotational movement is the axis 648 connecting the top cover 630 and the envelope 610. The apparatus 600 further comprises two buttons 621, 622 connected to the envelope 610 or to a rear cover 665 connecting the apparatus 600 and a garment warn by a user of the apparatus 600. The garment may be a vest or belt warn by a law enforcement officer. In some exemplary cases, the top cover 630 is pushed to the upward position when the user presses the two buttons 621, 622 simultaneously, as detailed below. In other cases, the top cover 630 is pushed to the upward position upon pressing of one button only. The two buttons 621, 622 are used to increase safety and prevent a case in which one button of the two buttons 621, 622 is pressed by mistake or by accident.

In some cases, the top cover 630 is made of a rigid material such as metal or plastics. The top cover 630 may comprise a front panel 632 and a side panel 633 for securing the upper portion 615 of the grenade 602 as shown in FIG. 6B. The upper portion 615 of the grenade 602, also referred to as a fuse, is a sensitive part of the grenade 602. The front panel 632 and a side panel 633 are made of a rigid material and prevent exposure of the grenade fuse to the environment, especially during combat or training.

The top cover 630 may also include a protruding tooth 620 for pushing the grenade 602 away from the envelope 610 when the top cover 630 is moved from the downward position to the upward position. The protruding tooth 620 protrudes from the bottom surface of the top cover. The protruding tooth 620 may be perpendicular to the bottom surface of the top cover 630. The protruding unit 620 is located in a manner that enables it to touch the grenade 602 when the top cover 630 is moved upwards.

Figure 7A:
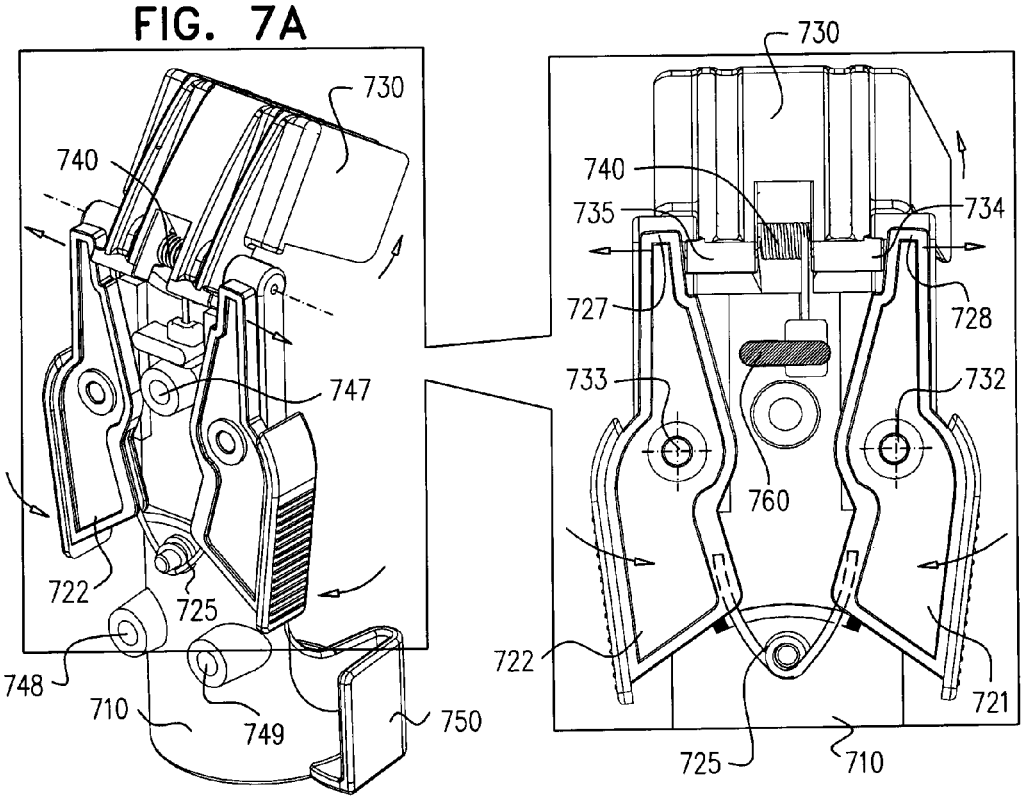
FIG. 7A shows a rear view of an apparatus for holding a grenade with a top cover in an upward position, according to some exemplary embodiments of the subject matter.
Figure 7B:
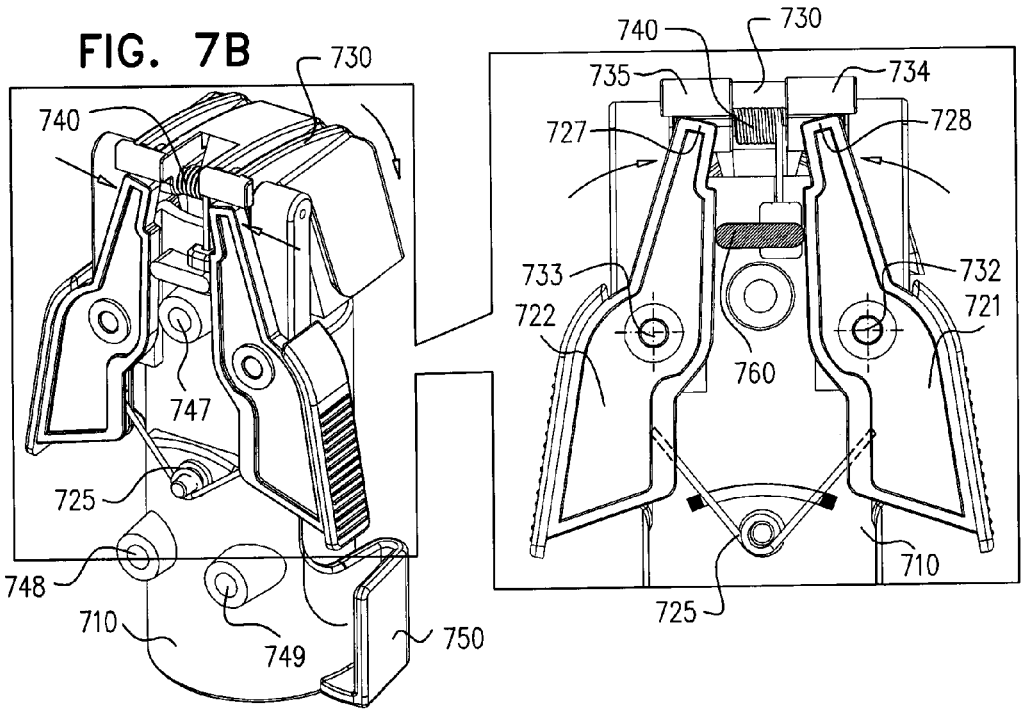
FIG. 7B shows a rear view of an apparatus for holding a grenade with a top cover in a downward position, according to some exemplary embodiments of the subject matter.

The apparatus 600 may also comprise a rear cover 665 for covering the mechanism disclosed in FIGS. 7A-7B. The rear cover is connected to the rear surface of the envelope 610. The limb 665 is positioned between the envelope 610 and the user's garment. The rear cover 665 may include mechanical tracks or hooks for attaching the apparatus 600 to a vest worn by a user, or to an adapted positioned on the vest. The rear cover 665 may be connected to a stopper 670 configured to limit the movement of the top cover 630 when moving to the upwards position. The stopper 670 is configured to hold the top cover 630 when the top cover 620 moves in a rotational movement to the upwards position, for example stop the top cover 630 at 60 degrees from the ground. The apparatus 600 may also comprise a soft inner lining 635 connected to the bottom portion of the top cover 630. The soft inner lining 635 may be made of a soft material such as a sponge, configured to safely hold and prevent any damage to the upper portion 615 of the grenade 602.

FIG. 6B shows a front view of an apparatus for holding a grenade with a top cover in a downward position, according to some exemplary embodiments of the subject matter. When the spring 640 is tensed, the top cover 630 is in the downward position. When the buttons 621, 622 are pressed, the spring 640 is released and the top cover 630 moves to the upward position.

FIG. 6B also shows the grenade 602 mounted at the apparatus 600, on top of the base 608. The top cover 630 in downward position is in contact with the upper portion 615 of the grenade 602, for securing the explosives contained in the grenade fuse. FIG. 6B also shows the mechanism for releasing the ring holder 145 from a pull ring 140 of the grenade 602. The ring holder 145 is connected on one end to a cord 135 and on another end to the pull ring; said cord 135 is connected to the envelope 610 or to the rear cover 665, or to an adapted positioned on the user's vest. The ring holder 145 is fastened to the pull ring 140 by the user, when inserting the grenade 602 into the apparatus 600.

FIG. 7A shows a rear view of an apparatus for holding a grenade with a top cover in an upward position, according to some exemplary embodiments of the subject matter. As disclosed above, the apparatus of the present invention includes two buttons 721, 722, that, when pressed by the user, the spring 740 is released, which results in maneuvering the top cover 730 to the upward position. The two buttons 721, 722 are connected to the envelope 710 of the apparatus, for example to the rear surface of the envelope 710, between the envelope and the garment warn by the user of the apparatus. The buttons 721, 722 may be positioned below the top cover 730, such that a user may press the buttons 721, 722 and grab the grenade and the grenade lever in a single hand when releasing the grenade from the apparatus In some cases, a back spring 725 connects the buttons 721, 722. When the top cover 730 is in the downward position, the buttons 721, 722 are distanced from each other and the back spring 725 is tensed. When the top cover 730 is in the downward position, the buttons 721, 722 are distanced from each other and the back spring 725 is tensed.

The top cover 730 comprises two protruding elements 734, 735 extending from the back end of the top cover 730. The two protruding elements 734, 735 are mounted on top of the upper ends 727, 728 of the buttons 721, 722 when the top cover 730 is in the downward position. The two protruding elements 734, 735 keep the top cover 730 from moving to the upward position when the spring 740 is tensed. When the user presses the buttons 721, 722, the upper ends 727, 728 of the buttons 721, 722 move aside, and do not hold the two protruding elements 734, 735 the spring 740 is released and the top cover 730 moves to the upwards position.

In some cases, the buttons 721, 722 are connected to the envelope 710 using two axes 732, 733, such that pressing the buttons 722, 721 causes the upper ends 727, 728 of the buttons 721, 722 to move apart from each other.

When the spring 740 is tensed and the back spring 725 is released, the movement of the buttons 721, 722 is limited by a blocking element 760 that protrudes from the rear surface of the envelope 710. When the top cover 730 is in the downward position, the two protruding elements 734, 735 are mounted on top of the upper ends 727, 728 of the buttons 721, 722. The blocking element 760 limits the movement of the buttons 721, 722 and thereby sets the position of the upper ends 727, 728 of the buttons 721, 722 to be under the two protruding elements 734, 735. When the top cover 730 is in upward position, the two protruding elements 734, 735 prevent the buttons 721, 722 from returning to their original position and prevent the buttons 721, 722 from being triggered. When the top cover 730 is pushed to the downward position by the user, the back spring 725 forces the buttons 721, 722 to return to the original position and be triggered for further use.

FIG. 7B shows a rear view of an apparatus for holding a grenade with a top cover in a downward position, according to some exemplary embodiments of the subject matter. The apparatus may also include connectors 747, 748 and 749 for connecting the envelope 710 to the rear cover 665 of FIG. 6A. The apparatus also shows a safety lever container 750 as disclosed above.

FIGS. 8A and 8B show a front view of an apparatus for holding a sphere-like shaped grenade with a top cover in an upward position and a downward position, according to some exemplary embodiments of the subject matter. The apparatus comprises two buttons (only 821 is shown) used to release a spring to move the top cover 830 upwards. The apparatus also comprises an envelope 810 connected to the top cover 830 and to a spherical base 808. The envelope 810 is connected to the top cover 830 via an axis 848. A rear cover 865 is connected to the rear surface of the envelope 810, for attaching the apparatus to a vest or to an adapter mounted on the vest.

The spherical base 808 holds the sphere-like shaped grenade 802 to prevent the grenade 802 from falling out of the apparatus when the top cover 830 is in upward position. Other embodiments of the apparatus may be designed for other shapes, sizes and types of grenades as desired by a person skilled in the art, by modifying the design of the base and the envelope. The apparatus also shows a safety lever container 850 as disclosed above.

Figure 11:
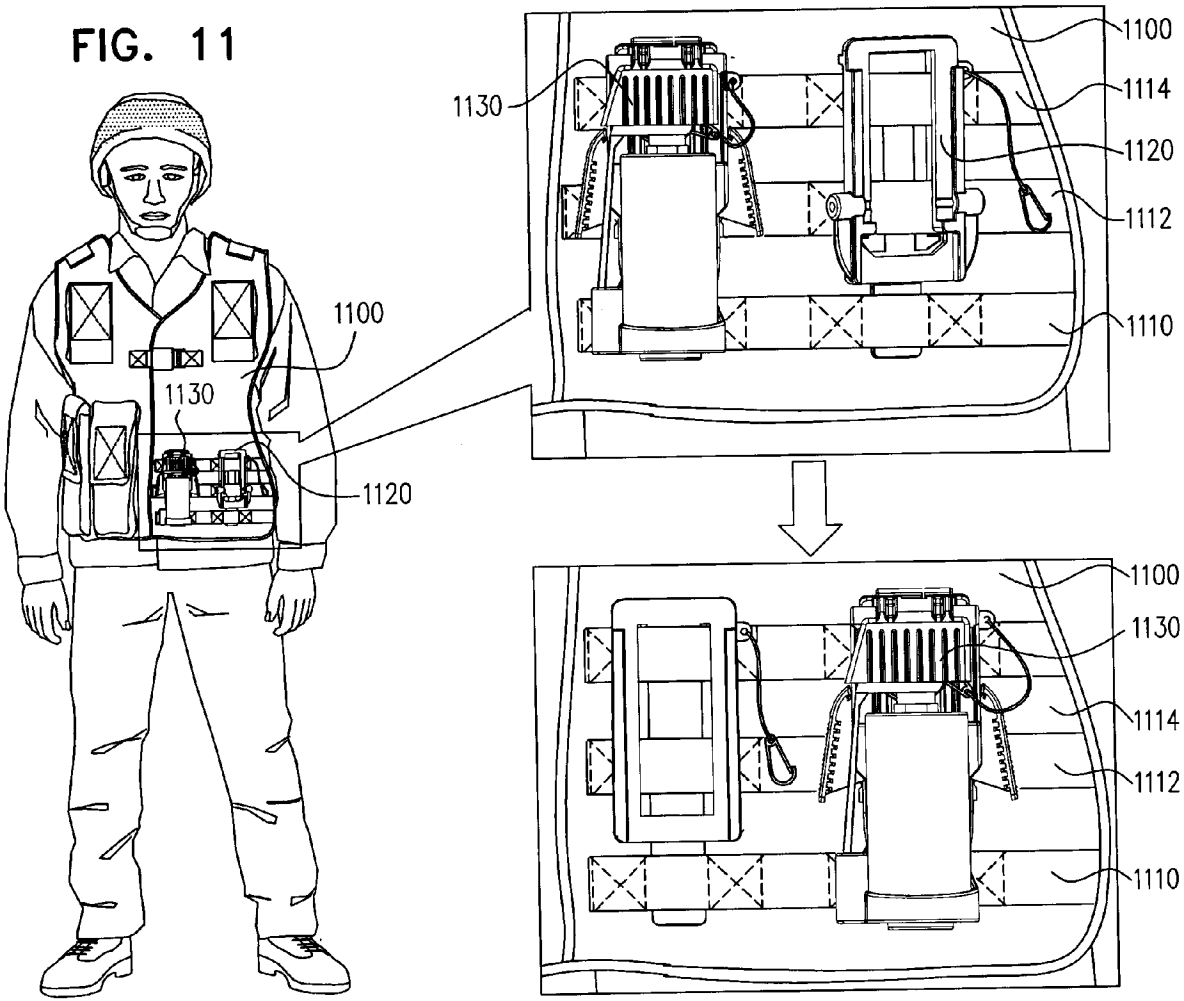
FIG. 11 shows a vest having multiple positions for attaching the apparatus for holding a grenade, according to some exemplary embodiments of the subject matter.

FIGS. 9A and 9B show a rear view of an apparatus for holding a sphere-like shaped grenade with a top cover in an upward position, according to some exemplary embodiments of the subject matter. FIG. 9A shows the two buttons 921, 922 used to release the spring that causes the top cover 930 to move to the upward position. The apparatus also shows a safety lever container 950 as disclosed above. The apparatus also includes a rear cover 965 for connecting the apparatus to a garment worn by a person, such as a law enforcement officer. The rear cover 965 may include connecting elements such as bolts, or comprise a mechanical track 940, 945 that fits a corresponding structure on the garment. In some exemplary cases, the rear cover 965 fits more than one structure on the garment, such that the user can move the apparatus from one structure to another structure on the garment, for convenience, as shown in FIG. 11. The rear cover may be connected to the vest using a hook 990, without requirement of the adapter.

FIG. 9B shows a rear view of the apparatus in which the rear cover 965 is positioned in an angle versus the garment. That is, the base of the apparatus, in which the grenade is mounted, is not parallel to the ground. The angle between the base and the ground may improve the usability of the apparatus, for example when the apparatus is positioned on the side of the garment and the user is required to move her elbow behind the back in order to release the grenade from the apparatus. In some exemplary cases, the apparatus comprises a mechanism, such as an axis, that enables regulating the angle between the attaching utensil 965 and the garment, such that the user can change the angle according to the position of the apparatus on the garment.

FIG. 10 shows a rear view of an apparatus for holding a grenade with a connector to a garment, according to some exemplary embodiments of the subject matter. The apparatus shows the two buttons 1021, 1022 used to release the spring 1040 and move the top cover to the upward position shown in FIG. 10. The spring 1025 connects the two buttons 1021, 1022. The apparatus also shows a safety lever container 1050 as disclosed above.

FIG. 11 shows a vest having multiple positions for attaching the apparatus for holding a grenade, according to some exemplary embodiments of the subject matter. The vest 1100 has a plurality of straps 1110, 1112, 1114 positioned horizontally at least on the front surface of the vest. An adapter 1120 is positioned between the straps 1110 and 1112 and is secured to the vest. The apparatus 1130 for holding a grenade may include mechanical tracks (not shown) that fit to the adapter 1120, such that the apparatus 1130 can be slid into the adapter 1120, thereby be attached to the vest 1100. Alternatively, the apparatus may be attached directly to the vest 1100 using the straps 1110, 1112, 1114. A user of the vest 1100 may move the apparatus 1130 from one adapter of the vest to another adapter, for convenience.

Figure 12:
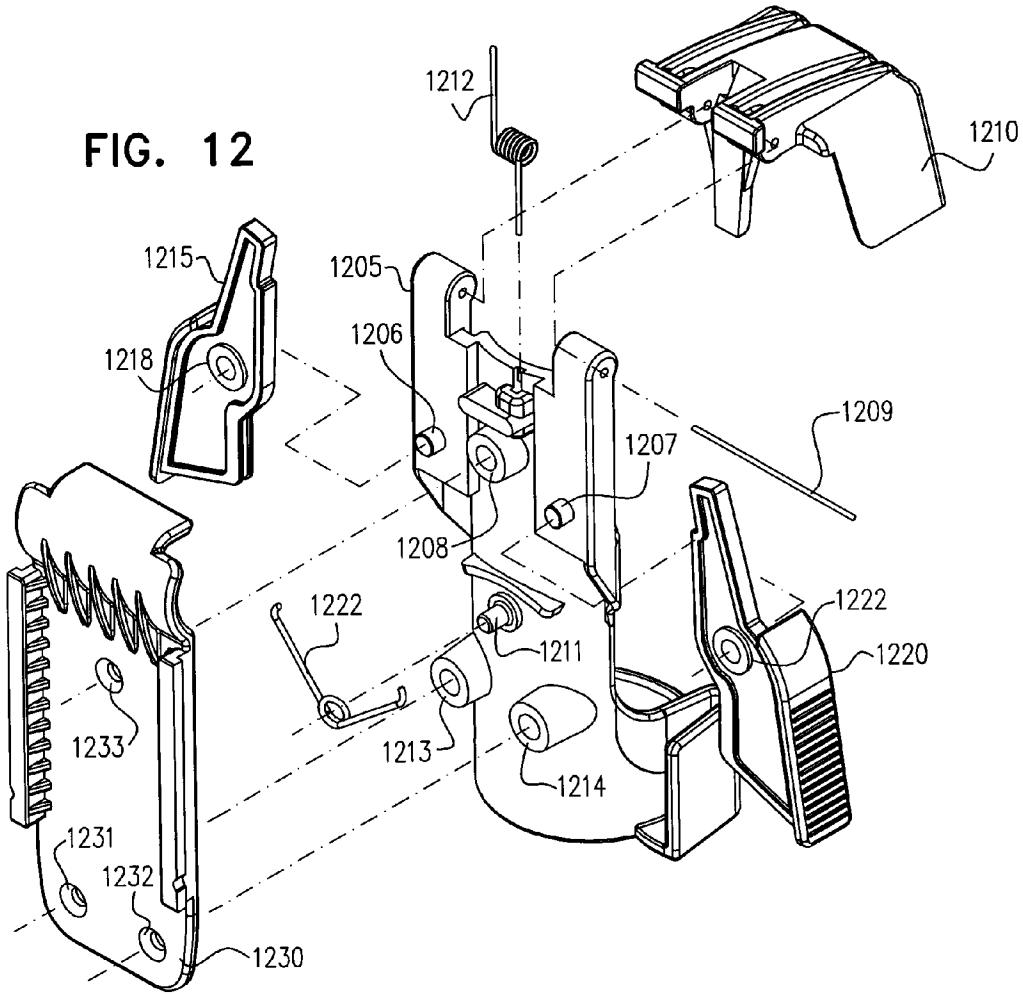
FIG. 12 shows an exploded view of the apparatus for holding a grenade, according to some exemplary embodiments of the subject matter; and, FIG. 13 shows an exploded view of the apparatus holding a spherical shaped grenade, according to some exemplary embodiments of the subject matter.

FIG. 12 shows an exploded view of the apparatus for holding a grenade, according to some exemplary embodiments of the subject matter. The apparatus comprises a top cover 1210, a spring 1212, an envelope 1205, two buttons 1215, 1220 having apertures 1218, 1222 respectively. The apertures 1218, 1222 are slid onto bolts 1206, 1207 on the rear surface of the envelope 1205. A back spring 1228 connects the two buttons 1215, 1220. An axis 1209 is inserted into holes of the envelope 1205, into the spring and into holes in the top cover 1210.

A rear cover 1230 is connected to the back surface of the envelope 1205. The rear cover 1230 contains 3 apertures 1231, 1232 and 1233 configured to be slid onto bolts 1213, 1214 and 1208 of the back surface of the envelope 1205. The back spring 1228 is connected to the envelope 1205 using a bolt 1211.

Figure 13:
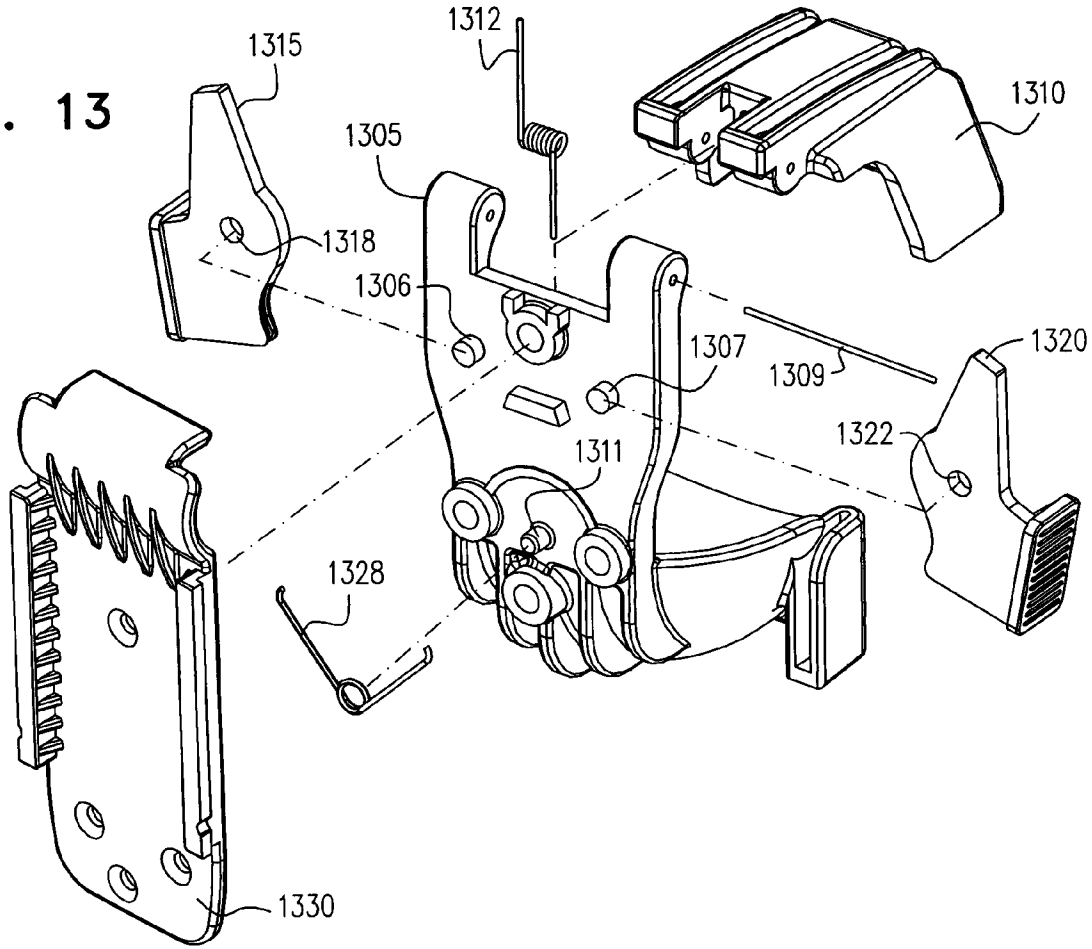

FIG. 13 shows an exploded view of the apparatus holding a spherical shaped grenade, according to some exemplary embodiments of the subject matter. The apparatus comprises a top cover 1310, a spring 1312, an envelope 1305, two buttons 1315, 1320 having apertures 1318, 1322 respectively. The apertures 1318, 1322 are slid onto bolts 1306, 1307 on the rear surface of the envelope 1305. A back spring 1328 connects the two buttons 1315, 1320 and is connected to the envelope 1305 via a bolt 1311. An axis 1309 is inserted into holes of the envelope 1305 and holes in the top cover 1310. A rear cover 1330 is connected to the back surface of the envelope 1305.

While the disclosure has been described with reference to exemplary embodiments, it will be understood by those skilled in the art that various changes may be made and equivalents may be substituted for elements thereof without departing from the scope of the subject matter. In addition, many modifications may be made to adapt a particular situation or material to the teachings without departing from the essential scope thereof. Therefore, it is intended that the disclosed subject matter not be limited to the particular embodiment disclosed as the best mode contemplated for carrying out this subject matter, but only by the claims that follow.

The invention claimed is:

1. An apparatus, comprising:

an envelope and a base connected to a bottom portion of the envelope for holding a grenade, a rear cover connected to the envelope for attaching said envelope to a vest of a user;

a top cover connected to an upper portion of the envelope, said top cover secures the grenade from above when positioned in a downward position and moves upwards to an upward position;

a spring connected on one end to the top cover and on another end to the envelope;

at least one button connected to the envelope or to the rear cover, wherein pressing the at least one button releases the spring and causes the top cover to move to the upward position;

wherein a user of the apparatus can release the grenade from the apparatus while pressing the at least one button;

wherein the at least one button is located below the top cover and connected only to one of the envelope or the rear cover;

wherein the envelope enables the user to hold the grenade and the grenade lever in a single hand when pressing the at least one button and when releasing the grenade from the apparatus.

2. The apparatus of claim 1, wherein the top cover is made of a rigid material.

3. The apparatus of claim 1, wherein the top cover surrounds an upper portion of the grenade, thereby securing explosives included in said upper portion.

4. The apparatus of claim 1, wherein the top cover is connected to the envelope on an axis, wherein the top cover moves to the upward position in a rotational movement around the axis.

5. The apparatus of claim 1, further comprising a protruding tooth for pushing the grenade away from the envelope when the top cover moves to the upward position, said protruding tooth protrudes from the top cover.

6. The apparatus of claim 1, further comprising a soft inner lining connected to a bottom portion of the top cover being in contact with an upper portion of the grenade when the top cover is in the downward position.

7. The apparatus of claim 1, wherein the spring is tensed when the top cover is in the downward position, wherein the spring is released when the at least one button is pressed, thereby the top cover moves to the upward position.

8. The apparatus of claim 1, wherein protruding elements of the top cover are mounted on an upper end of the at least one button when the top cover is in the downward position and the spring is tensed, and wherein pressing the at least one button changes the location of the upper end of the at least one button, thereby enabling the protruding elements to move downwards and release the spring, such that the top cover is enabled to move to the upward position.

9. The apparatus of claim 8, wherein the at least one button is two buttons, wherein the protruding elements are positioned between the two buttons when the top cover is moved to the upward position, to prevent the two buttons from returning to their original position.

10. The apparatus of claim 9, wherein pressing only one button of the two buttons fails to release the spring and fails to move the top cover to the upward position.

11. The apparatus of claim 9, further comprising a back spring connecting the two buttons, such that when the top cover is pushed downwards by the user, the back spring is tensed and the two buttons are distanced from each other.

12. The apparatus of claim 11, wherein the two buttons are automatically triggered by the back spring when the top cover is in the downward position.

13. The apparatus of claim 1, further comprising a mechanical track connected to the rear cover for connecting the apparatus to the vest, wherein the mechanical track enables connecting the apparatus to a plurality of locations on the vest.

14. The apparatus of claim 1, further comprising a drop shot hook used for hanging the apparatus on the vest without an adapter.

15. The apparatus of claim 1, further comprising a safety lever container connected to the envelope, said safety lever container is configured to secure and protect the grenade lever of the grenade.

16. The apparatus of claim 1, further comprising a ring holder connected to the envelope, said ring holder is configured to hold a pull ring, such that the pull ring is detached from the grenade responsive to removal of the grenade from the envelope.

17. The apparatus of claim 16, wherein the ring holder is a karabiner, wherein the karabiner is fastened to the pull ring.

18. The apparatus of claim 16, wherein the ring holder is connected to the envelope by a cord, such that the pull ring is detached from the grenade responsive to moving the grenade from the envelope at a distance longer than the cord's length.

19. The apparatus of claim 16, wherein the rear cover is connected to the vest at an angle versus the ground.

* * * * *